United States Patent [19]

Takahashi

[11] Patent Number: 4,717,059

[45] Date of Patent: Jan. 5, 1988

[54] LABEL POSITIONING METHOD AND LABEL FEEDER FOR CONTINUOUS LABEL PRINTER

[75] Inventor: Mitsuharu Takahashi, Fujisawa, Japan

[73] Assignee: Kabushiki Kaisha Sato, Japan

[21] Appl. No.: 582,840

[22] Filed: Feb. 23, 1984

[30] Foreign Application Priority Data

Feb. 28, 1983 [JP] Japan ..... 58-30746

[51] Int. Cl.[4] ..... B65H 23/192

[52] U.S. Cl. ..... 226/2; 226/33; 226/43

[58] Field of Search ..... 226/10, 24, 27, 32, 226/33, 37, 43, 152, 156, 2; 33/125 M, 129, 132 R, 132 A, 133, 134 R, 141 R, 141 B, 141.5, 142; 101/73, 74, 75, 66; 242/57; 73/157; 209/534, 553, 577, 659

[56] References Cited

U.S. PATENT DOCUMENTS

| | | | |
|---|---|---|---|
| 2,290,871 | 7/1942 | Freedman | 101/66 X |
| 2,824,736 | 2/1958 | Allen | 101/66 X |
| 2,968,236 | 1/1961 | Swett | 101/66 |
| 3,174,610 | 3/1965 | Barbagallo et al. | 226/9 X |
| 3,198,114 | 8/1965 | Jones et al. | 226/33 X |
| 3,392,895 | 7/1968 | Ellner et al. | 226/152 |
| 3,767,098 | 10/1973 | Pabodie | 226/117 |
| 3,856,128 | 12/1974 | Taggart | 226/32 X |
| 4,002,279 | 1/1977 | Klein | 226/2 |
| 4,037,768 | 7/1977 | Escales | 226/33 X |
| 4,176,944 | 12/1979 | Payrhammer | 226/33 X |
| 4,196,665 | 4/1980 | Rogers et al. | 101/66 |
| 4,316,566 | 2/1982 | Arleth et al. | 226/2 |
| 4,453,823 | 6/1984 | Sugita et al. | 226/33 X |
| 4,462,587 | 7/1984 | Graef et al. | 209/534 X |

OTHER PUBLICATIONS

Davis, W. M. and R. E. Yates, *Label Printer*, IBM Technical Disclosure Bulletin, vol. 16, No. 4, Sep. 1973, pp. 1149–1150.

*Primary Examiner*—Harvey C. Hornsby
*Assistant Examiner*—Scott J. Haugland
*Attorney, Agent, or Firm*—Ostrolenk, Faber, Gerb & Soffen

[57] ABSTRACT

A label positioning method and a label feeder for use with a continuous label printer are disclosed. The printer includes a stationary printing head for printing in position the leading label of any of several kinds of continuous label webs. Each label web has a longitudinal series of labels of a given label length. For each label length, a corresponding value is stored in a memory. Each label has a detection mark, such as a cut, for indicating the position of the label. While a central processor energizes rollers to feed the web by steps, a detector signals adjacent detection marks, so that the central processor determines label length. The value corresponding to the label length of a label web to be printed is selected from the memory by the central processor. When the detector, which is upstream from the printer, detects a cut indicating the position of the leading label, the central processor feeds the label web to be printed a distance corresponding to the selected value. As a result, the leading label is positioned for printing by the printing head.

23 Claims, 4 Drawing Figures

LABEL POSITIONING METHOD AND LABEL FEEDER FOR CONTINUOUS LABEL PRINTER

BACKGROUND OF THE INVENTION

1. Field of the Invention

The present invention relates to a label feeder for use with a continuous label printer and, more particularly, to a label feeder which can automatically position the leading label to be printed of any of several different continuous label webs, each having a series of labels.

2. Description of the Prior Art

A technique is known for automatically setting the leading printing position of each label of a continuous label web by bringing the leading printing position of the label to be printed to a printing head when a detector detects a mark on the label web. The mark on the label web provides a position setting standard. According to this known technique, the printing operation is started in response to a mark detection signal outputted from the detector, so that the leading label is printed with desired indicia when it reaches a predetermined position.

However, the continuous label printer using a continuous label web of price labels or the like usually prints several kinds of continuous label web, each kind composed of labels having a different size, depending upon the quantity of data to be printed or upon the printing format.

In the case of the printer of the above type, no serious problem arises where the continuous label webs to be printed have different label widths. Where the label sizes are different in the longitudinal direction, however, a detector must be provided for each label size in order to set the leading printing position as described above. In order to set the leading printing position by means of a single detector, on the other hand, the detector must be moved to a preassigned position each time the continuous label webs are interchanged to change the label size.

Thus, the former technique of providing a detector for each label size is disadvantageous not only because the necessary circuit is complicated but also because the mountings and sensitivity adjustments of the respective detectors are troublesome. Moreover, the latter technique of moving a single detector in accordance with the label sizes is problematic because the moving operation requires much time and labor and the positioning of the printing operation is unreliable.

SUMMARY OF THE INVENTION

The present invention has been conceived in view of the problems intrinsic to the prior art described above. One object of the present invention is to provide a label feeder which can automatically position the leading label to be printed even if a continuous label printer to be used therewith is loaded with various kinds of continuous label webs having different label sizes in the longitudinal direction.

Another object of the present invention is to provide a label feeder which need not be provided with a different detector for each different label size.

A further object of the present invention is to provide a label feeder which need not have its single detector moved in accordance with a change in label size.

According to a feature of the present invention, a method of positioning the leading label of a continuous label web having a longitudinal series of labels for printing or other treatment includes selecting a value corresponding to the label length from a memory storing a plurality of such values; feeding the label web past a detector until it detects a feature, such as a cut, in a predetermined location in relation to the leading label; and feeding the label web a distance corresponding to the selected value to position the leading label. In one embodiment, the method also includes determining the length of the labels. The web is preferably fed in steps so that the label length may be determined by counting the steps between the features and the distance fed may be an integral multiple of the step distance.

According to another feature of the present invention, a label feeder for use with a continuous label printer includes a feeding means for feeding a continuous label web past a printing head; a detector for signalling detection of a feature located in a predetermined position in relation to a label; a storage means for storing a plurality of values, each corresponding to a label length; and control means for retrieving a stored value corresponding to the length of the labels on the web, receiving the detection signal, and controlling the feeding means to feed the web from the initial position of a leading label a distance corresponding to the retrieved stored value. The feeding means preferably includes a pulsed motor for feeding the web in steps by driving one of a pair of opposed feed rollers. The features may preferably be cuts in the cutting lines between labels, so that the control means may also determine the label length by counting the number of steps between features, and the distance corresponding to the stored value may be measured by counting steps until the stored value is reached.

Because any of a plurality of values corresponding to label length may be selected from memory, the invention eliminates the need to move the detector or to use plural detectors for plural label lengths.

Other objects, features and advantages of the present invention will become apparent from the following description taken in conjunction with the accompanying drawings.

DESCRIPTION OF THE PREFERRED EMBODIMENTS

Figure 1:
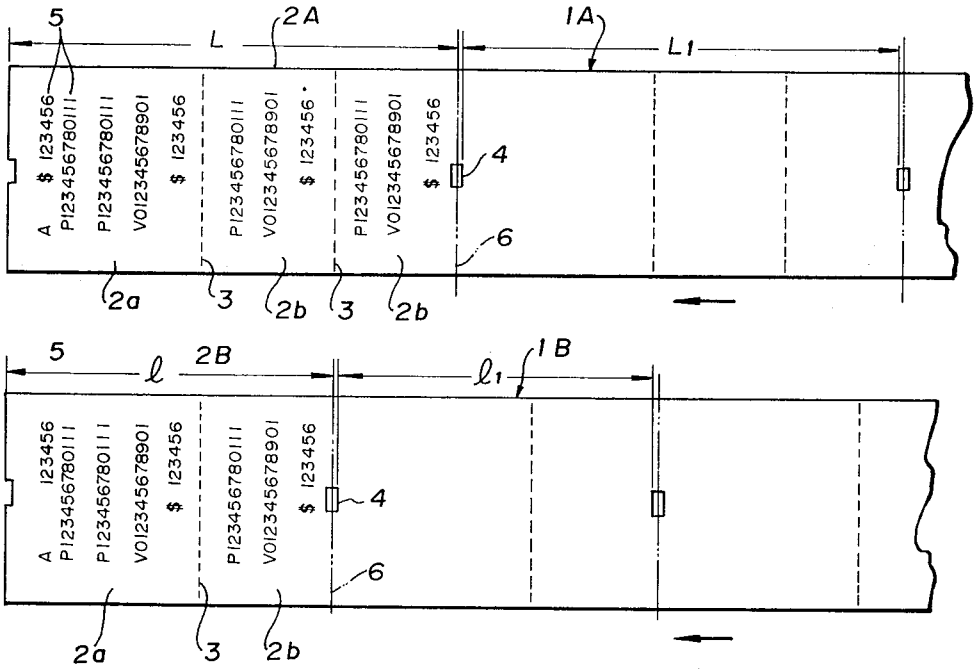
FIG. 1 is a top plan view showing the leading portions of two continuous label webs of the kind used with the embodiments of the present invention.

The embodiments of the present invention will now be described in detail with reference to the accompanying drawings. For simplicity of explanation, the description of the embodiments will be made assuming that two kinds of continuous label webs 1A and 1B are used, having respective longitudinal label sizes L and l, as shown in FIG. 1. The two kinds of continuous label webs 1A and 1B shown in FIG. 1 each include a longitudinal series of labels or tags, for illustrative purposes only. Other items of uniform length mounted on a continuous web could also be used with the invention. These continuous label webs 1A and 1B are each formed with detection marks or cuts 4 or other similar detectable features, which are arranged at intervals equal to the lengths of the labels 2A and 2B. Moreover, each of these labels 2A and 2B is divided by transverse perforations 3 into a data portion *2a* for the customer and a data portion or portions *2b* to be processed. More specifically, each label 2A of the continuous label web 1A is provided with two data portions *2b* to be processed, whereas each label 2B of the continuous label web 1B is provided with one data portion *2b* to be processed.

Double-dotted lines 6 appearing in FIG. 1 indicate cutting lines along which the continuous label webs 1A and 1B are cut after indicial data 5 have been printed. Incidentally, the aforementioned detection cuts 4 of the label webs 1A and 1B, which provide the positioning standards for the leading labels 2A and 2B, are formed on the cutting lines 6 which extend transversely between any two longitudinally adjoining labels 2A and 2B of the label webs 1A and 1B. As a result, when the label web 1A or 1B is cut along one of the cutting lines 6, a single label or tag 2A or 2B can be removed and separated along the line or lines of perforations 3 into the customer's data portion *2a* and the processed data portion or portions *2b*.

Figure 2:
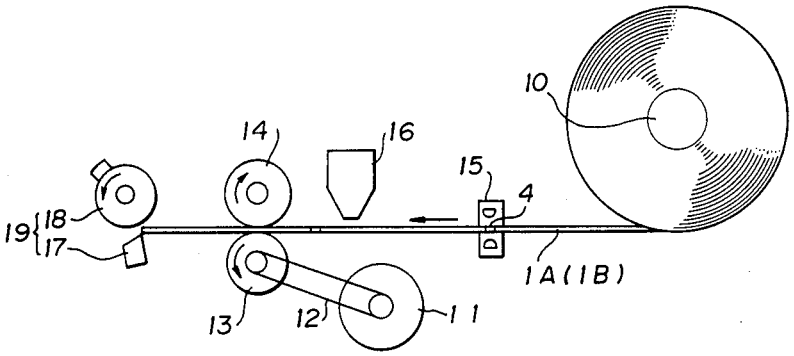
FIG. 2 is a schematic side view showing components of the label feeder of the present invention arranged in a continuous label printer.

FIG. 2 shows the aforementioned continuous label web 1A or 1B wound on a label holder 10 of a printer. The invention could also be used in any other apparatus for processing items on a continuous web using a processing unit along the feed path of the web. The continuous label web 1A or 1B is suitably fed by a pair of feed rollers 13 and 14 which are rotationally driven by a pulsed motor 11 or other appropriate stepping means through a timing belt 12. The label web 1A or 1B could be driven by any other appropriate arrangement including feeding means of some sort. These feed rollers 13 and 14 are arranged downstream from a stationary printing head 16 with respect to the feeding direction of the label web 1A or 1B. The feed rollers 13 and 14 are positioned adjacent to each other with a clearance between them for the passage of the label web, so that the rollers 13 and 14 together pull the label web in the feeding direction. During this feeding operation, the detection cut 4 located on the trailing cutting line 6 of the leading unprinted label 2A or 2B is detected by means of a photoelectric detector 15 located upstream from the printing head 16. As appears more fully below, detector 15 may detect features such as the beginning or end of the cut 4 as the label web is fed along the feed path. Leading label 2A or 2B is then printed with the desired indicial data 5 by the action of the stationary printing head 16 which may be of the thermal, electrostatic or drum impact types. Moreover, the continuous label web 1A or 1B thus printed is cut along its leading cutting line 6 by the action of a cutter 19 which is constructed of a stationary knife 17 and a rotary knife 18.

Figure 3:
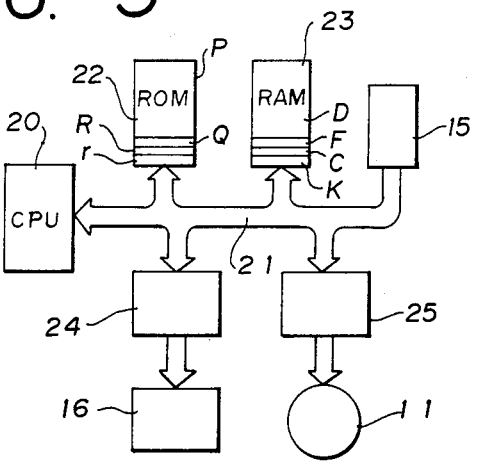
FIG. 3 is a block diagram illustrating one embodiment of the present invention, including an electronic circuit for driving and controlling the label printer and the label feeder of FIG. 2.

The electronic circuit illustrated in FIG. 3 is used to control the continuous label printer and the label feeder together. A central processing unit (CPU) 20 is connected with a read only memory (ROM) 22 and a random access memory (RAM) 23 through a bus 21. Other appropriate circuitry could be used, however, for storage means and control means. The ROM 22 stores a program P; a value Q for providing a standard for discriminating the label size in the longitudinal direction, i.e., the length of the labels; a value R for providing a standard for setting the leading printing position of the continuous label web 1A having the label length L; a value r for providing a standard for setting the leading printing position of the continuous label web 1B having the label length l; and predetermined natural numbers X and Y for use in detecting error conditions. X and Y may be imbedded in program P rather than stored separately. Moreover, the RAM 23 includes a data storage D for storing the indicial data to be printed; a flag F; a counter C; and a value storage K for storing the value R or r from ROM 22. The counter C is adapted to be reset by the output signal or the mark detection signal coming from the detector 15 and to be incremented at each step of the pulsed motor 11. Incidentally, the flag F and the counter C may be constructed of independent circuits connected to the bus 21 without using any portion of RAM 23.

The bus 21 is also connected to a print controller 24 for controlling the printing operation of the printing head 16, to a motor energizer 25 for energizing the pulsed motor 11 to control its driving motion, and to the detector 15. Thus, the setting of the leading printing position of the respective labels 2A or 2B on the continuous label web 1A or 1B, i.e., the positioning of the leading unprinted label 2A or 2B of the label web 1A or 1B, is performed by suitably controlling the feeding of the label web 1A or 1B. This is done using the electric circuit including CPU 20, ROM 22 and RAM 23. CPU 20 sends control signals to each of the other components to control their operation.

Figure 4:
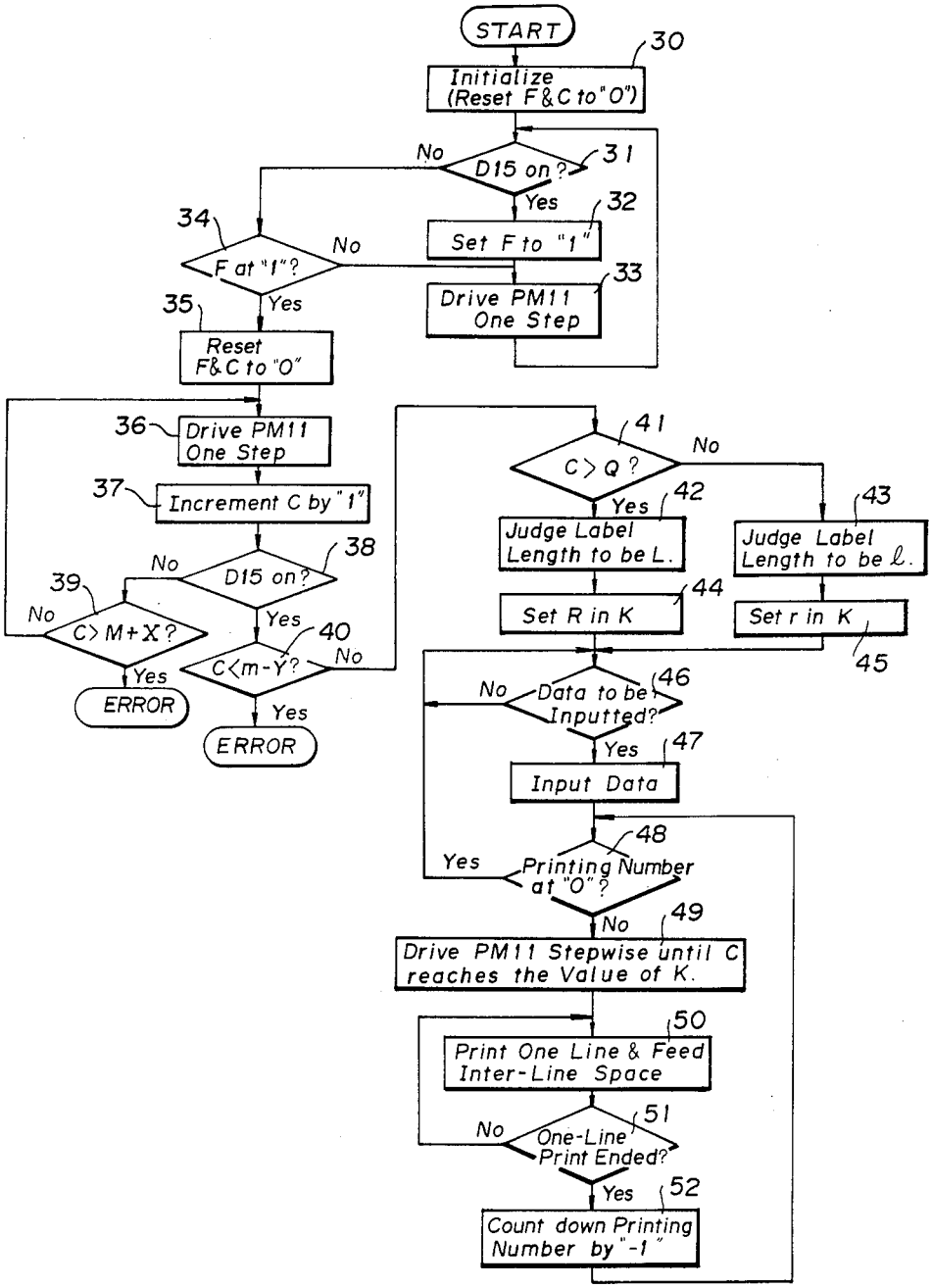
FIG. 4 is a flow chart illustrating the operation of the electronic circuit of FIG. 3.

FIG. 4 is a flow chart showing the steps performed by CPU 20 in the operation of the circuit of FIG. 3, according to program P. The operation of discriminating the label sizes of the continuous label webs 1A and 1B shown in FIG. 1 and the operation of setting the leading printing position of the respective labels 2A and 2B in accordance with the label sizes discriminated will now be described with reference to FIG. 4. Assume that the pulsed motor 11 must be advanced by M and m steps, respectively, so as to feed the continuous label webs 1A and 1B, having the respective label lengths L and l, a distance equal to the respective intercut length $L_1$ and $l_1$ between adjoining detection cuts 4 ($l<L$; $l_1<L_1$; and $m<Q<M$).

When label discrimination starts, initialization is performed at Step 30 to reset the flag F and the counter C to "0". After this, Step 31 tests for the presence of a mark detection signal from the detector 15. When the mark detection signal is present, the flag F is set to "1" at Step 32, and the pulsed motor 11 is driven one step distance at Step 33 to feed the continuous label web 1. After this, the test at Step 31 is repeated. If Step 31 determines that there is no signal from the detector 15, on the other hand, the state of the flag F is tested at a Step 34. If the flag F is not at "1" but at "0", the program goes to Step 33. In other words, Steps 31, 32 and 33 are repeated if the detector 15 detects the detection cut 4, but otherwise the Steps 31, 34 and 33 are repeated until the detection cut 4 is detected.

When there is no signal from the detector 15 and the flag F is at "1", Step 34 decides that the detector 15 has detected the trailing edge of the detection cut 4, shown toward the right in FIG. 1, i.e. the detection cut 4 located on the trailing cutting line 6 of the leading label 2A or 2B to be printed. After this decision, Step 35 resets the flag F and the counter C to "0".

After Step 35, the actual length discrimination begins, with pulsed motor 11 driven one step at Step 36 and counter C incremented by "+1" at Step 37. After this, the output signal from the detector 15 is tested again at Step 38. When no mark detection signal is received, Step 39 decides whether the counted value of the counter C is larger than (M+X) (wherein X designates a predetermined natural number). If so, the measured length is greater than the maximum length permitted, so that an error condition exists. If not, the program returns to Step 36.

Steps 36 to 39 are repeated until the detector 15 detects the leading edge of the next detection cut 4, shown toward the left in FIG. 1, and provides a mark detection signal. Then, Step 40 decides whether or not the counted value of the counter C is smaller than (m−Y) (wherein Y designates a predetermined natural number). If so, the measured length is smaller than the minimum length permitted, so that an error condition exists. If not, the program proceeds to Step 41.

Step 41 decides whether or not the counted value of the counter C is larger than Q. If so, the continuous label web is judged to be label web 1A which is composed of labels 2A having the length L. If not, the continuous label web is judged to be label web 1B which is composed of labels 2B having the length l.

If the label length is L, the value R from ROM 22 is retrieved and is stored in the value storage K of RAM 23 at Step 44. If the label length is l, on the other hand, the value r from ROM 22 is retrieved and is stored in the value storage K of RAM 23 at Step 45. Incidentally, the respective values R and r are the numbers of steps of the pulsed motor 11 required to position the leading unprinted label 2A or 2B of the continuous label web 1A or 1B at the printing head 16 after the detector 15 has detected the detection cut 4. Therefore, the respective distances corresponding to R and r will be integral multiples of one step distance.

Step 46 next decides whether the data to be printed should be inputted or not. If so, the data are inputted at Step 47. Then, Step 48 decides whether or not the printing number, indicating the number of labels to be printed, is "0". If not, Step 49 drives the pulsed motor 11 stepwise until the counter C, which is reset by the end of the mark detection signal from detector 15, reaches the value R or r from value storage K of RAM 23. The resetting of the counter C is performed as a part of a preliminary feeding step which may be a part of step 50 or may occur as early as Step 41, after C has been compared to Q. This preliminary feeding step preferably aligns the leading label 2A or 2B by feeding the label web stepwise until the mark detection signal from detector 15 ends, signalling the position of the leading label. Then counter C may count up to R or r. In the case of continuous label web 1A having label length L, pulsed motor 11 is driven by R steps after the detector 15 has detected the end of detection cut 4. In the case of continuous label web 1B having label length l, on the other hand, pulsed motor 11 is driven by r steps. As a result, whether the continuous label web is 1A or 1B, the leading label 2 to be printed is positioned correctly in a predetermined position at the printing head 16.

When the leading printing position is set, step 50 performs a one-line print and a line-space feed of the continuous label web 1A or 1B in a repeated manner. If step 51 decides that the repeated one-line prints and line-space feeds to print one label 2A or 2B are completed, step 52 decrements the printing number by "−1", and the program returns to Step 48.

In the embodiments thus far described, incidentally, the discrimination of label size is performed automatically by way of example only. This discrimination can also be performed by manually inputting the necessary signal with the use of a keyboard or the like. Moreover, the label length is exemplified by the two lengths L and l but may be of three or more lengths. In this modification, values corresponding to the values R and r may be stored for each respective label size. If the leading printing position is to be shifted for one of the label sizes, moreover, it is sufficient to add or subtract a suitable value to or from the corresponding one of the values R and r when it is stored in the value storage K.

In the label feeder according to the present invention, as has been described above, the value corresponding to the label length of the continuous label web to be printed is selected. The detector 15 detects the mark in a predetermined order. The label web feeding motor 11 is then driven to longitudinally advance the label web loaded in the printer, by a distance corresponding to the selected value. Then the leading label to be printed reaches the printing position. As a result, it is unnecessary to provide a detector for each respective label size, which simplifies the circuit construction and facilitates the mounting and the sensitivity adjustment of the detector. Since the detector need not be moved in accordance with a change in label size, moreover, operation is greatly simplified.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A method for automatically positioning, relative to a print head, labels which are longitudinally ordered on a web, the labels having a label length which equals one of a plurality of predetermined label lengths, each label further having a detectable indicia thereon, the method comprising the steps of:

storing in a memory values representative of the plurality of predetermined label lengths;

storing in the memory at least one value representative of a begin-printing location on the labels where information may be printed;

automatically feeding the web past a detector capable of detecting the detectable indicia and detecting a first one of the detectable indicia located on a leading one of the labels;

detecting a next one of the detectable indicia which is spaced from the detectable indicia at a distance which provides a measure of label length;

automatically calculating the label length on the basis of the distance between the detected indicia;

comparing the calculated label length to at least one reference value stored in the memory and, on the basis of the comparison, selecting one of the stored label lengths as a label length value for the labels being fed; and advancing the web by a distance which is determined by the at least one value representative of the begin printing location, on the basis of the selected label length value to place the web in a printing position.

2. The method of claim 1, in which the web is fed by a stepper motor and in which the step of calculating the label length is effected by counting the number of times by which the stepper motor is operated to feed the web.

3. The method of claim 2, in which the at least one value representative of the begin-printing location includes a plurality of values, each of the values being respectively associated with a respective one of the predetermined label lengths, and in which the web is advanced to the printing position based on the one of the values which is associated with the selected label length value.

4. A feeder for feeding labels to a print head wherein the labels are longitudinally ordered on a web and wherein the labels have a label length which equals one of a plurality of predetermined label lengths, each label further having a detectable indicia thereon, the apparatus comprising:

a memory and a plurality of values representative of the predetermined label lengths stored in the memory;

at least one value representative of a begin-printing location for the label lengths stored in the memory;

a detector for detecting first and second consecutive ones of the detectable indicia on the web;

means for feeding the web past the detector; and control means responsive to the detector for obtaining a measured label length value, for comparing the measured label length value to at least one reference value and, on the basis of the comparison, for selecting one of the stored label lengths as the label length for the labels on the web, and for actuating the feeding means to advance the web by a distance which is determined by the at least one value representative of the begin-printing location stored in the memory, on the basis of the selected label length.

5. The feeder of claim 4, wherein the feeding means comprises a stepper motor.

6. The feeder of claim 5, in which the control means comprises means for counting the number of steps by which the stepper motor is advanced.

7. The feeder of claim 5, in which the at least one value representative of begin-printing location includes a plurality of values, each of the plurality of values being associated with a respective one of the predetermined label lengths, the control means further being effective for controlling the feeding means to advance the web to the printing location based on that one of the begin-printing location values which is associated with the selected label length value.

8. The method of claim 1 in which the steps of automatically feeding the web and detecting the detectable indicia includes the substeps of:

aligning the leading one of the labels on the label web with the first one of the detectable indicia leading one of the labels at a detecting position adjacent the detector;

longitudinally feeding the label web a step distance and incrementing a count of the step distances fed;

detecting whether the next one of the detectable indicia is at the detecting position; and repeating the longitudinally feeding and incrementing substep and the detecting substep until the detector detects the next one of the detectable indicia.

9. The method of claim 8 in which the aligning substep comprises longitudinally feeding the label web a step distance at a time until the detector detects the first one of the detectable indicia.

10. The method of claim 1 which includes the step of preliminarily feeding the label web a step distance at a time until the detector detects the first detectable indicia, the first detectable indicia being the end of a cut located at the trailing edge of the leading label.

11. The method of claim 1 in which advancing the web step comprises the substeps of:

longitudinally feeding the label web a step distance and updating a count of step distances fed;

comparing the count of step distances fed with one of the at least one value representing the begin printing location; and repeating the longitudinally feeding and updating substep and the comparing substep until the count of step distances is at least as great as said one of the at least one value.

12. The method of claim 1 in which the advancing the web step comprises longitudinally feeding the label web a step distance, the distance determined by the at least one value being an integral multiple of the step distance.

13. A method of printing labels positioned according to the method of claim 1, comprising:

printing the leading label when the leading label is in the printing position.

14. The feeder of claim 4 in which the feeding means comprises stepping means for feeding the label web a step distance in response to a control signal from the control means, the distance determined by the at least one value representative of the begin printing location being an integral multiple of the step distance.

15. The feeder of claim 14 in which the control means is further operable for counting the number of the step distances the label web is fed between the sensing of the first and next ones of the detectable indicia for obtaining said measured label length value.

16. The feeder of claim 14 in which the feeding means further comprises first and second opposed feed rollers positioned adjacent each other on respective first and second opposite sides of a feed path for engaging the label web between the feed rollers for pulling the label web in the feeding direction, the feed rollers being disposed in the feeding direction from the printing head.

17. The feeder of claim 16 in which the stepping means comprises a pulsed motor connected for driving one of the first and second feed rollers.

18. The feeder of claim 4 in which the detector comprises a photoelectric detector disposed in a direction generally opposite the feeding direction from the printing head.

19. The feeder of claim 4 in which the memory comprises a bus, a read only memory and a random access memory, the read only memory and the random access memory being connected by the bus.

20. The feeder of claim 19 in which the control means comprises a central processing unit connected for sending control signals through the bus, the feeder further comprising a feeding means energizer connected for receiving control signals from the central processing unit through the bus and connected to the feeding means for energizing the feeding means in response to the control signals.

21. The feeder of claim 4 in which each detectable indicia is one of a plurality of cuts on the label web, each pair of longitudinally adjacent labels on the label web having one of the cuts formed on a cutting line therebetween, each cutting line being transverse to the feeding direction.

22. The feeder of claim 21 in which the detector includes means for detecting the end of the cut on the cutting line between the leading label and the adjacent following label.

23. The feeder of claim 4 wherein a plurality of continuous label webs is provided; each label web having a plurality of labels having one of said predetermined label lengths; said feeding means feeding any selected one of the plurality of webs which is first manually inserted in the feeder in accordance with the label length of the selected web.

* * * * *